US006212807B1

(12) United States Patent
Wright

(10) Patent No.: US 6,212,807 B1
(45) Date of Patent: Apr. 10, 2001

(54) VARIABLE CHARACTER DISPLAY SYSTEM

(76) Inventor: Robert J. Wright, c/o Baker Graphics, Inc. 37 Hanna Avenue, Toronto, Ontario (CA), M6K 1Wp ( * ) Notice: Subject to any disclaimer, the term of this patent is extended or adjusted under 35 U.S.C. 154(b) by 0 days.

(21) Appl. No.: 09/251,445

(22) Filed: Feb. 17, 1999

(51) Int. Cl.[7] ..... G09F 3/04

(52) U.S. Cl. ..... 40/450; 40/450; 40/595; 40/638

(58) Field of Search ..... 40/450, 451, 595, 40/638; 340/815.44; 345/34; 434/160

(56) References Cited

U.S. PATENT DOCUMENTS

| | | | | |
|---|---|---|---|---|
| 3,967,022 | * | 6/1976 | Hasei | 40/638 X |
| 4,059,912 | | 11/1977 | Noah . | |
| 4,115,936 | | 9/1978 | Nidelkoff . | |
| 4,344,994 | * | 8/1982 | Batty et al. | 40/595 X |
| 4,507,888 | | 4/1985 | Robinson et al. . | |
| 4,539,768 | | 9/1985 | Halliday . | |
| 4,583,312 | * | 4/1986 | King et al. | 40/450 X |
| 4,729,184 | | 3/1988 | Cihanek . | |
| 4,777,747 | | 10/1988 | Murray . | |
| 4,858,357 | | 8/1989 | Thorn . | |
| 5,249,382 | | 10/1993 | Moynihan . | |
| 5,566,482 | * | 10/1996 | Smith | 40/450 |
| 5,577,336 | | 11/1996 | Jensen . | |
| 5,601,682 | | 2/1997 | Longtin . | |
| 5,621,993 | * | 4/1997 | Stover | 40/638 |
| 5,680,719 | | 10/1997 | Poser . | |

* cited by examiner

*Primary Examiner*—Terry Lee Melius
*Assistant Examiner*—James M Hewitt
(74) *Attorney, Agent, or Firm*—Evenson, McKeown, Edwards & Lenahan, P.L.L.C.

(57) ABSTRACT

A variable character display and a method for making and using the display is provided. The display is composed of three layers of material including a substrate layer having an adhesive side and a non-adhesive side of a first color. A backing layer is secured to the adhesive side of the substrate and a front layer having an adhesive backing is secured to the non-adhesive side of the substrate layer. The front layer is provided with a plurality of individual removable sections arranged in at least one figure eight configuration. The individual sections are selectively removable to form a specific number on the substrate layer. The individual sections are a second color that is different than the first color.

7 Claims, 3 Drawing Sheets

VARIABLE CHARACTER DISPLAY SYSTEM

BACKGROUND OF THE INVENTION

1. Field of the Invention

The present invention is related to signs, and particularly to signs for displaying characters, which are frequently changed, such as numbers used to indicate prices or the like.

2. Description of Related Art

Signs are frequently used to display prominently the prices being currently charged for products, especially for gasoline, diesel fuel, and the like at service stations, as well as for soda, fresh fruit and vegetables, milk, and other staple food products often sold at roadside stands or advertised and sold in stores. Previously, such signs have frequently utilized separate figures, made, for example, of solid black plastic sheet material cut to the shape of individual digits, with each digit being mounted against a white background which may be internally illuminated to make the sign readable at night. Changes in the prices displayed by such signs require removal of one digit and its replacement by another, different, digit. Therefore, for prices up to and including nine dollars, ninety nine cents ($9.99), twenty-nine separate numeral characters are required in order to be able to display each possible price. Such numeral characters, usually made of rigid plastic sheet material, are subject to being broken, either by being blown off the sign and breaking upon impact with the ground, or as a result of being dropped while numbers are being changed. Once broken, a numeral must be replaced. As a result, spare numerals must be kept on hand, at greater expense and requiring more storage space.

In many circumstances, such as retail sales, it is often desirable to present or display information such as pricing, or even stock or code numbers, relevant to any given item. Thus, for example, in a supermarket or other retailer having high inventory turnover, prices may change from week to week, or possibly even daily. The use of digital figures is commonly known from displays in, for example, CPUs, telephones and digital watches, where the individual figure section contains seven elements which may be activated electronically so as to form a combination showing a figure in the range of 0 to 9. A corresponding display of letters is also possible, but requires a slightly larger number of basic elements to be able to display any letter in the alphabet.

There are several mechanical devices known in the prior art for displaying prices, but they also represent very high and significant capital costs. For example, U.S. Pat. No. 4,115,936 teaches a sign which has self-storing characters that are quickly changeable. However, although the background and the characters may have color contrast and/or illumination, the change is made by moveable shutters—in other words, using moveable and specific mechanical pieces. Obviously, the capital costs of such a device are quite high.

A similar device, having bar segments which may be altered using magnetic material, is shown in U.S. Pat. No. 4,507,888. Yet another device is shown in U.S. Pat. No. 4,539,768. Here again, specific flaps or mechanical means are required to change each segment so as to alter its value.

U.S. Pat. No. 4,858,357 is directed to a reusable card for exhibiting and displaying alphanumeric information, such as a pricing sign for retail use. At least a portion of the face of the card has a background formed thereon in a dark color, and a plurality of multi-segmented alphanumeric presentation display digits. Each of the display digits has at least seven bar segments so arranged as to form the digit "8". Various alphanumeric digits or letters can be formed by changing the color of none or some of the bar segments of each display digit, so as to change its value, using a marker having an ink which is substantially the same color as the color of the background. The card may be reused by wiping the changed display digits with a dampened wiping means which may carry water or a specific solvent, depending on the nature of the ink that has been used in the marker when the display digit was first changed.

Electrically controlled multi-element illuminated signs have become available in recent years, and are convenient to use. Such signs, however, are very expensive to build, operate and maintain. Except for locations atop tall poles along major highways, where prices must be seen at a great distance in order to attract motorists to leave the highway, such signs are too expensive to be practical.

U.S. Pat. No. 5,680,719 describes a display sign having an adjustable "eight" configuration with seven segments. The segments are removably attached to a background member and may be provided with a pressure sensitive adhesive coating. U.S. Pat. No. 4,777,747 discloses a price designating sign using the segmented "eight" configuration in which cover elements may have an adhesive side adhering to a background board 10.

With the exception of the electronic and ink signs, in the above-described signs the numbers are formed by placing various pieces on a background. The ink based sign requires that a specific series of spaces be colored a different color to form a digit. Thus, these signs all are purchased by a user with a background section having no number thereon. These signs come to the user in a number of loose pieces. The sign's background must have the segments "filled-in", either by small pieces or by an ink pen to produce the digit. Thus, the user is required to create each number by placing or coloring a segment in a required position. This requires additional time to assemble and increases the number of loose pieces in a package containing the sign when sent to the user. In addition, when signs contain many loose pieces, there is a chance pieces could be lost. Also, the signs requiring many pieces to form a number are expensive and are not susceptible to a singe use and then disposal.

Accordingly, what is needed is an easily revised display sign which is attractive in appearance, is much less costly than such electrically controllable illuminated signs so as to be disposable, and which does not require the maintenance and storage of a large number of numeral characters which take up a relatively large amount of space while they are not in use.

SUMMARY OF THE INVENTION

It is therefore an object of the present invention to provide a variable character display sign which is easily manipulated to provide a desired display of characters at a low cost. The display product initially begins with all of the character segments positioned on a sign substrate forming a character such as a figure eight digit. Because of this, certain segments only have to be removed to obtain the desired digits. This manner of forming the desired display may be advantageous when a piggy back substrate is used, the substrate being applied against cardboard signs and the like forming, for example 12/24 pack soda displays. The display product can be sold in one-piece at a low cost. Moreover, it is easy to use and does not require assembly from separate components (segments) to form the sign. Rather, the display product requires only disassembly to form the desired sign. Because the display is relatively inexpensive, it is capable of a single use then disposal. It is also advantageously flexible and lightweight due to a preferred piggyback paper construction.

To obtain these and other advantages, one aspect of the present invention is a variable character display having three layers. The display includes an intermediate substrate layer having an adhesive side and a non-adhesive side, the non-adhesive side is a first color. A backing layer is secured to the adhesive side of the substrate layer, thereby protecting the adhesive side of the substrate layer until the display is ready to be placed in the correct advertising position. The display also includes a front layer having an adhesive backing and a non-adhesive side. The front layer is adapted to be positioned onto the non-adhesive side of the substrate layer. The front layer further comprises a plurality of individual, removable sections, at least some of which are arranged in at least one figure eight configuration. The individual sections are selectively removable to form a specific number when the display is positioned for advertising. The individual sections are a second color that is different than the first color in order to provide a contrast of color in the elements to ensure the formed number is easily seen.

Another aspect of the present invention is a method for making a variable number display. The method includes the steps of forming a substrate layer having an adhesive side and a non-adhesive side of a first color and securing a removable backing layer to the adhesive side of the substrate layer. The method includes the further step of forming a front layer having an adhesive side and a non-adhesive side of a second color. The method also includes the step of forming in the front layer a plurality of removable sections in the shape of at least one figure eight, the sections being a third color that is different than the first and second colors. Of course, the first and second colors may be the same. Another step according to the inventive method includes securing the adhesive side of the front layer to the non-adhesive side of the substrate layer. Another step of the invention is forming at least one number by selectively removing a predetermined number of the sections.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

BRIEF DESCRIPTION OF THE DRAWINGS

The invention will be better understood and objects other than those set forth above will become apparent when consideration is given to the following detailed description thereof which makes reference to the annexed drawings wherein.

DESCRIPTION OF THE PREFERRED EMBODIMENTS

Figure 1A:
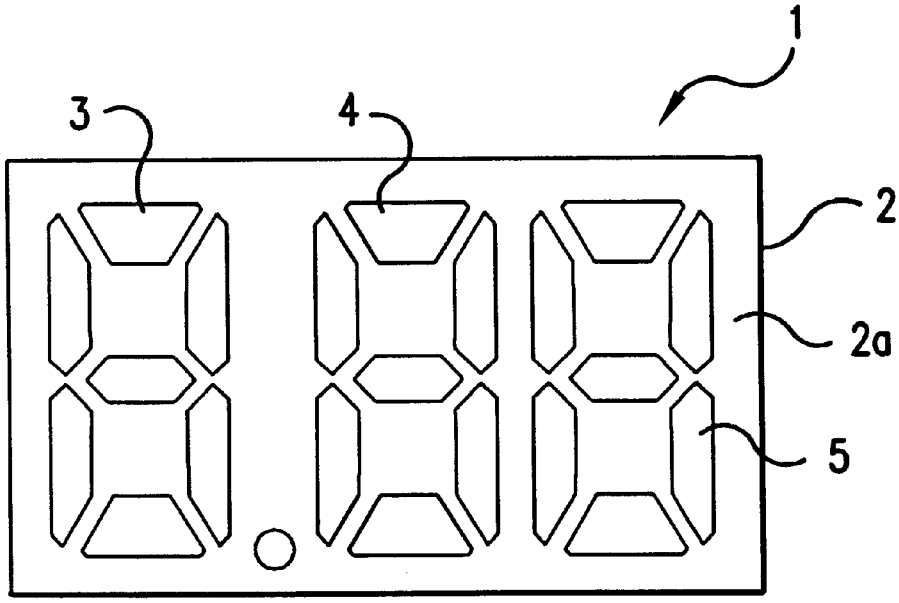
FIG. 1A is a front perspective view of a variable number display sign according to the present invention.
Figure 2A:
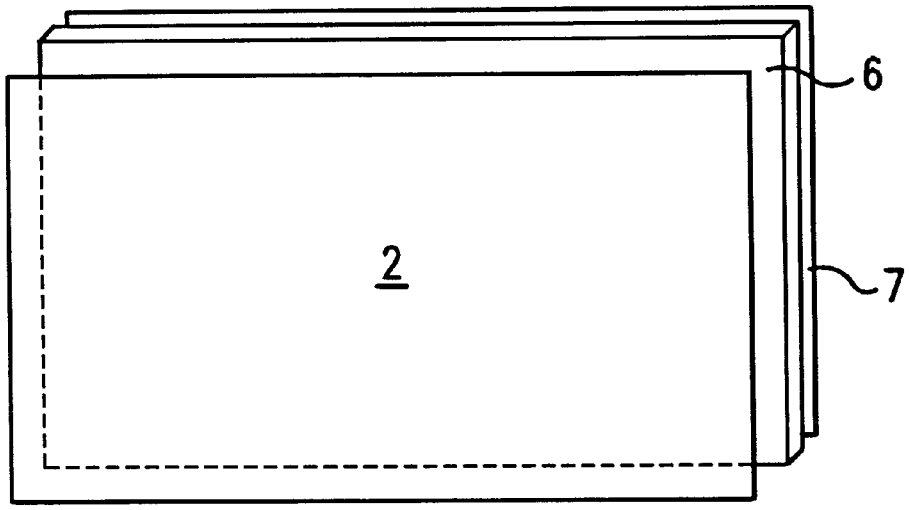
FIGS. 2A and 2B are front perspective and side exploded views respectively of the three layers of the variable number display sign.
Figure 2B:
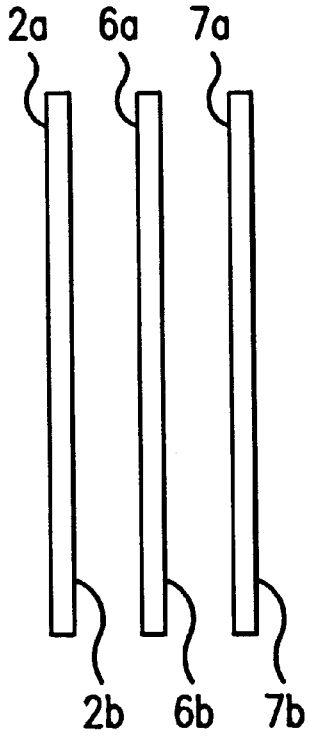

FIG. 1A shows a display sign 1, for exhibiting and displaying alphanumeric information. Display sign 1 is preferably designed as a three-layer sign, as illustrated in FIG. 2A, having a front layer 2, a substrate layer 6 and a backing layer 7. As illustrated in FIG. 2B, each layer 2, 6 and 7 has two sides. Front layer 2 has a front side 2*a* and a back side 2*b*; substrate layer 6 has a front side 6*a* and a back side 6*b*; and back layer 7 has a front side 7*a* and a back side 7*b*. Back side 2*b* is secured to front side 6*a*, and back side 6*b* is secured to front side 7*a*. Preferably, back sides 2*b* and 6*b* of front layer 2 and substrate layer 6 respectively, have an adhesive thereon to adhere to the corresponding sides 6*a* and 7*a*. Back layer 7 has no adhesive on either side.

Figure 1B:
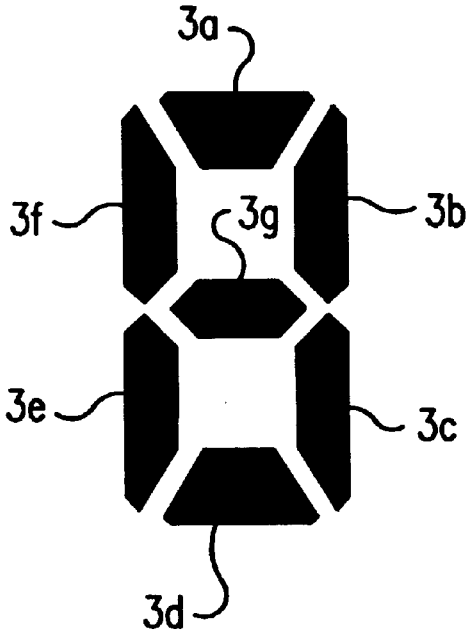
FIG. 1B is a front view of the segments making up an alpha-numeric figure according to the present invention.

Front layer 2 is provided with at least one alpha-numeric digit 3. Preferably, there are a plurality of alpha-numeric digits 3, 4 and 5. As illustrated in FIG. 1B, each alpha-numeric digit consists of a plurality of separate segments, 3*a* through 3*g*. In the illustrated embodiment, there are seven separate segments. Each segment has a front surface and a rear surface. The front surface of each of the segments 3*a* through 3*g* is a color that is different from the color of front side 2*a*. Preferably, the colors of segments 3*a*–3*g* and 2*a* are of high contrast. For instance if the color of front side 2*a* is white, the color of each segment 3*a*–3*g* is preferably dark, such as black, blue, red, etc. The color of segments 3*a*–3*g* is preferably black, but it may be other colors such as dark green, dark red, dark blue, etc. The color of front side 2*a* is preferably white, but may be other colors provided the color chosen is of sufficiently high contrast to the color chosen for segments 3*a*–3*g*.

Figure 4:
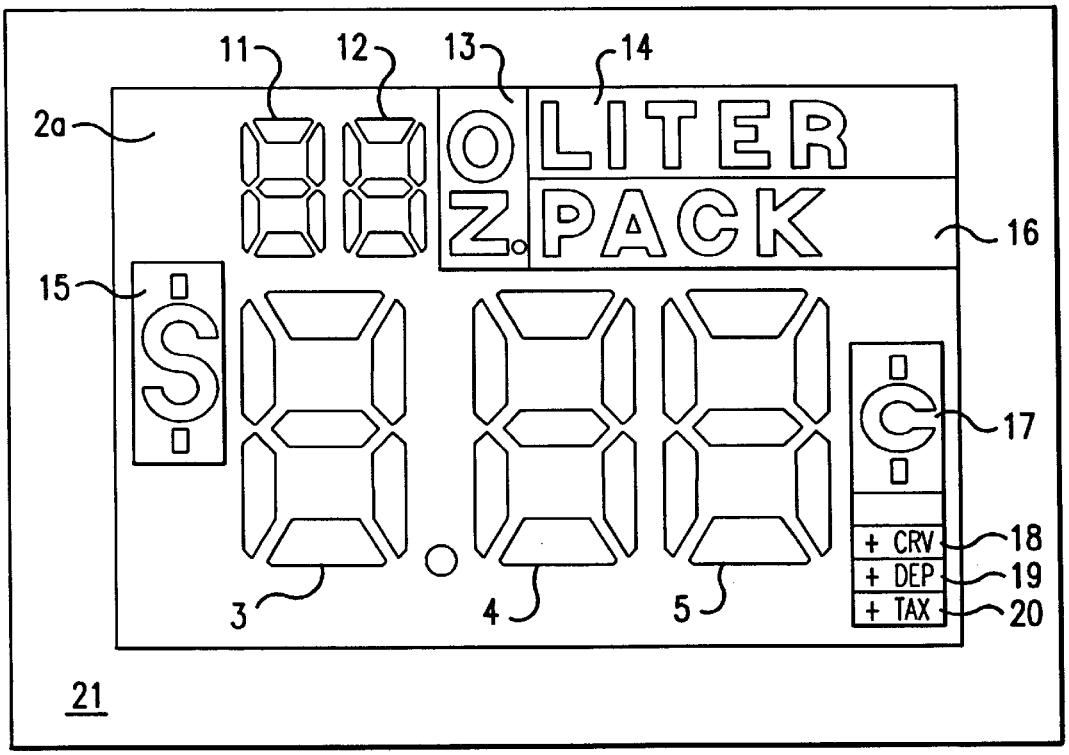
FIG. 4 is a front view of a variable display sign having additional removable sections.

In FIGS. 1A and 4, the alpha-numeric digits 3, 4, 5, 11 and 12 are shown as the same color as front side 2*a* of front layer 2 and front side 6*a* of substrate layer 6. This was done for illustrative purposes only, and shows that once a particular segment 3*a*–3*g* is removed, front side 6*a* of substrate layer 6 and front side 2*a* of front layer 2 are of approximately the same color.

Front side 6*a* of substrate layer 6 is preferably the same color as the color chosen for front side 2*a* of front layer 2. This is so because as individual segments 3*a*–3*g* are selectively removed, front side 6*a* is exposed to the viewer of the sign. To form a selected number, the contrast of colors between segments 3*a*–3*g*, 2*a* and 6*a* must be such as to allow a visual representation to a viewer.

Figure 3:
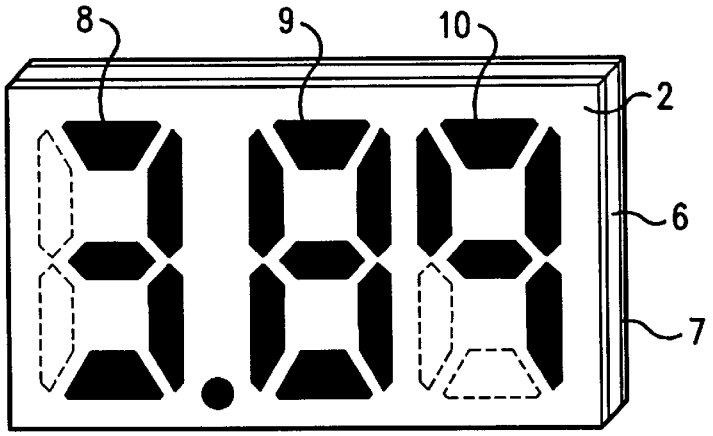
FIG. 3 is a front perspective view of the variable number display sign illustrating a number formed on the front layer of the sign.

FIG. 3 illustrates an example of a variable character display according to the present invention. In this example, the alpha-numeric digits 8, 9 and 10 have been formed into the number "3.89". To form this number, segments 3*f* and 3*e* were removed from digit 8 thereby forming the number "3", no segments were removed from digit 9 thereby forming the number "8" and segments 3*e* and 3*d* were removed from digit 10 to form the number "9". As evident from this example, the variable character display is formed with all of segments 3*a*–3*g* in place. Thus, the display originally will indicate the number "8.88". To form the final number, various segments 3*a* and 3*g* are selectively removed. This represents a novel distinction over the above-described prior art where the display originally has no number on it and pieces have to be added to form the number. The present invention provides a much easier and quicker number creating device. In addition, there is less of a chance to lose loose pieces since all of segments 3*a*–3*g* are adhesively secured to front side 6*a* of substrate 6.

Alteratively, the various segments 3*a*–3*g* may be removed to form letters to form a word. Additional segments may be added to the figure eight layout such that each letter of the alphabet could be formed by selective removal of segments.

In addition to the variable numbers for the display sign, such a sign may also carry a message imprinted thereon, or additional numbers may also be required on the sign. Such a sign is illustrated in FIG. 4. In this case, several messages are imprinted on the front side 2*a* of the display sign. Two additional numbers 11, 12 are provided. These numbers can be made according to the above description using segments 3*a*–3*g*. The abbreviation "oz." is provide in segment 13. Word segments 14 and 16 provide the words "liter" and "pack", respectively. Segments 15 and 17 provide the dollar and cent symbols, and segments 18–20 each provide additional abbreviations. Each of the segments 11–20 on front side 2*a* of front layer 2 is formed in the same manner as segments 3*a*–3*g* and are selectively removable. Obviously, the descriptions in each of the illustrated word segments can vary depending on the nature of what is being advertised.

As noted above, front layer 2 is secured to substrate layer 6. Preferably, back side 2*b* of front layer 2 is provided with an adhesive which is adapted to hold layer 2 on substrate 6. Similarly, back layer 7 is secured to substrate 6. Preferably, back side 6*b* of substrate layer 6 is provided with an adhesive to secure the front side 7*a* of layer 7 to back side 6*b* of substrate 6. When applying display 1 to a secondary support substrate 21,such as a prepared cardboard advertisement, back layer 7 is peeled from substrate 6 and the remaining substrate 6 having front layer 2 attached thereto is secured to the secondary support substrate.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A variable character display comprising:

a substrate layer having an adhesive side and a non-adhesive side, the non-adhesive side being of a first color;

a backing layer secured to the adhesive side of the substrate;

a front layer having a front surface and an adhesive back surface secured to the non-adhesive side of the substrate layer, the front layer having formed therein a plurality of individual removable sections arranged to form alpha-numeric characters, wherein the front surface, with the exception of the individual removable sections, is of a color substantially the same as the first color, the individual sections being of a second color that contrasts with the first color, the individual sections being selectively removable such that remaining individual sections form a specific alpha-numeric character on the front layer.

2. A variable number display according to claim 1, wherein the front layer further comprises at least one removable word segment, said at least one word segment further comprising at least one word, truncated word, abbreviation, symbols or group of words.

3. A variable number display according to claim 1, further comprising a secondary substrate adapted to support the substrate layer.

4. A variable number display according to claim 1, wherein the alpha-numeric characters are numbers.

5. A variable number display according to claim 4, wherein seven individual sections are arranged in a figure eight configuration group to allow each numerical digit to be formed.

6. A variable number display according to claim 1, wherein the alpha-numeric characters are letters.

7. A variable character display sign, comprising:

a thin, flexible piggyback substrate decal, the piggyback substrate decal including a backing layer, a basic substrate layer and a cover layer wherein removable segments of a segmented figure eight are formed in the cover layer;

wherein the basic substrate layer has a back adhesive surface on which the backing layer is removably adhered and a non-adhesive front surface of a first color;

further wherein a front surface of the cover layer, except for the removable segments, has a color substantially the same as the first color of the basic substrate, the removable segments having a contrasting color on the front surface, whereby individual ones of the removable segments are removed such that remaining ones of the removable segments form a specific character on the front layer; and, wherein the cover layer has a back adhesive surface to removably adhere the cover layer to the front surface of the basic substrate.

* * * * *